United States Patent [19]

Ruis et al.

[11] Patent Number: 4,543,039

[45] Date of Patent: Sep. 24, 1985

[54] STATOR ASSEMBLY FOR AN AXIAL COMPRESSOR

[75] Inventors: Jean-Pierre Ruis, Le Chatelet en Brie; Marcel R. Soligny, Chevilly-Larue, both of France

[73] Assignee: Societe National d'Etude et de Construction de Moteurs d'Aviation "S.N.E.C.M.A.", Paris, France

[21] Appl. No.: 547,711

[22] Filed: Nov. 1, 1983

[30] Foreign Application Priority Data

Nov. 8, 1982 [FR] France ..... 82 18651

[51] Int. Cl.[4] ..... F04D 29/54

[52] U.S. Cl. ..... 415/190; 415/189; 415/174

[58] Field of Search ..... 415/189, 190, 193, 172 A, 415/174, 117

[56] References Cited

U.S. PATENT DOCUMENTS

| | | | |
|---|---|---|---|
| 2,917,276 | 12/1959 | Klompas et al. | 415/189 |
| 2,980,396 | 4/1961 | Movsesian | 415/189 |
| 2,997,275 | 8/1961 | Bean et al. | 415/189 |
| 3,000,552 | 9/1961 | Cooper et al. | 415/194 |
| 4,083,180 | 4/1978 | Thompson et al. | 415/177 X |
| 4,426,191 | 1/1984 | Brodell et al. | 415/189 |
| 4,431,373 | 2/1984 | Monsarrat | 415/189 |

FOREIGN PATENT DOCUMENTS

| | | |
|---|---|---|
| 2238838 | 2/1975 | France . |
| 2421279 | 10/1979 | France . |
| 2452600 | 10/1980 | France . |
| 2482661 | 11/1981 | France . |
| 1501916 | 2/1978 | United Kingdom . |
| 2019954 | 11/1979 | United Kingdom . |

*Primary Examiner*—Robert E. Garrett
*Assistant Examiner*—John Kwon
*Attorney, Agent, or Firm*—Bacon & Thomas

[57] ABSTRACT

A device for attaching the stator vanes of an axial compressor to an external housing is disclosed. The attachment utilizes an inner casing, having the vanes mounted on it, and an outer casing surrounding the inner casing in such a manner that differential thermal expansion between the various elements is minimized. This allows more accurate control of the clearances between the rotor and the stator.

9 Claims, 5 Drawing Figures

STATOR ASSEMBLY FOR AN AXIAL COMPRESSOR

BACKGROUND OF THE INVENTION

The invention concerns a device for attaching the stator vanes of an axial compressor to an external housing. The device is particularly suitable for the active control of the clearance between the rotor and the stator. The stator vanes are fastened to an inner casing of the housing formed by at least one cylindrical ferrule which, in turn, is supported by fastening means on an internal wall of an outer casing. The space between the two casings is traversed by air from a stage of the compressor.

The nonsimultaneous heating and cooling of the different elements of a compressor make it difficult to control the clearance between the rotor and the stator. In effect, the vane disks of the rotor are thermally protected against the flow of compressed air so as to not attain the temperature of the casing supporting the stator vanes. It is known by engine designers to control the temperature of the outer casing carrying the stator vanes.

To accomplish this temperature control and to prevent the transmission of the heat of the compressed air to the outer casing, the stator vanes have been mounted on an inner casing made of a material having a low coefficient of thermal expansion, and suspended from the outer casing by fastening means.

The control of heat exchanged between the inner casing and the outer casing, made of a conventional material, is accomplished by the ventilation of the outer casing and of the space between the two casings.

French Pat. No. 2,482,661 discloses a compressor housing consisting of an outer casing with a plurality of ventilator tubes on its exterior surface and an inner casing, formed by annular segments, to which the stator vanes are fastened. The inner casing carries, facing the outer casing, a number of flanges forming an axially protruding edge to cooperate with radial raised edges of a corresponding shape provided on the inner face of the outer casing. The annular segments are held in place by a band with tongues preventing their circumferential displacement.

British Pat. No. 2,019,954 describes a compressor housing having annular, coaxial outer and inner casings. The inner casing carries the radially inwardly directed stator vanes and a plurality of projections extending in the outward direction. These projections cooperate with recesses provided in the outer casing. The inner casing consists of annular members placed one after the other along a longitudinal axis of the outer casing. The projections and the thickening of the zone surrounding their recesses form thermal bridges permitting the control of the thermal expansion or contraction of the inner casing in the radial direction.

In these known configurations, the stator vanes, together with the friction bands insuring the tightness of the blades of the rotor vanes, are fastened to the inner casing, of which they are an integral part. It is therefore difficult to gain access to the stator for the replacement of damaged vanes or friction bands.

SUMMARY OF THE INVENTION

It is the object of the present invention to permit the effective control of the clearance between the rotor and stator of the compressor by protecting the outer casing against thermal radiation of the flow of compressed air, but also to make possible the easy replacement of blades and friction bands of the stator.

The device according to the invention accomplishes this by forming the inner casing of at least one assembly of hollow, cylindrical sectors carrying the stator vanes and friction bands on their internal surfaces in a plurality of radial grooves and having a plurality of brackets capable of cooperating with corresponding brackets of the outer envelope on their outer surfaces.

BRIEF DESCRIPTION OF THE DRAWINGS

The explanation hereinbelow and the figures, given as examples, will make it apparent how the invention may be embodied.

DETAILED DESCRIPTION OF THE PREFERRED EMBODIMENT

Figure 1:
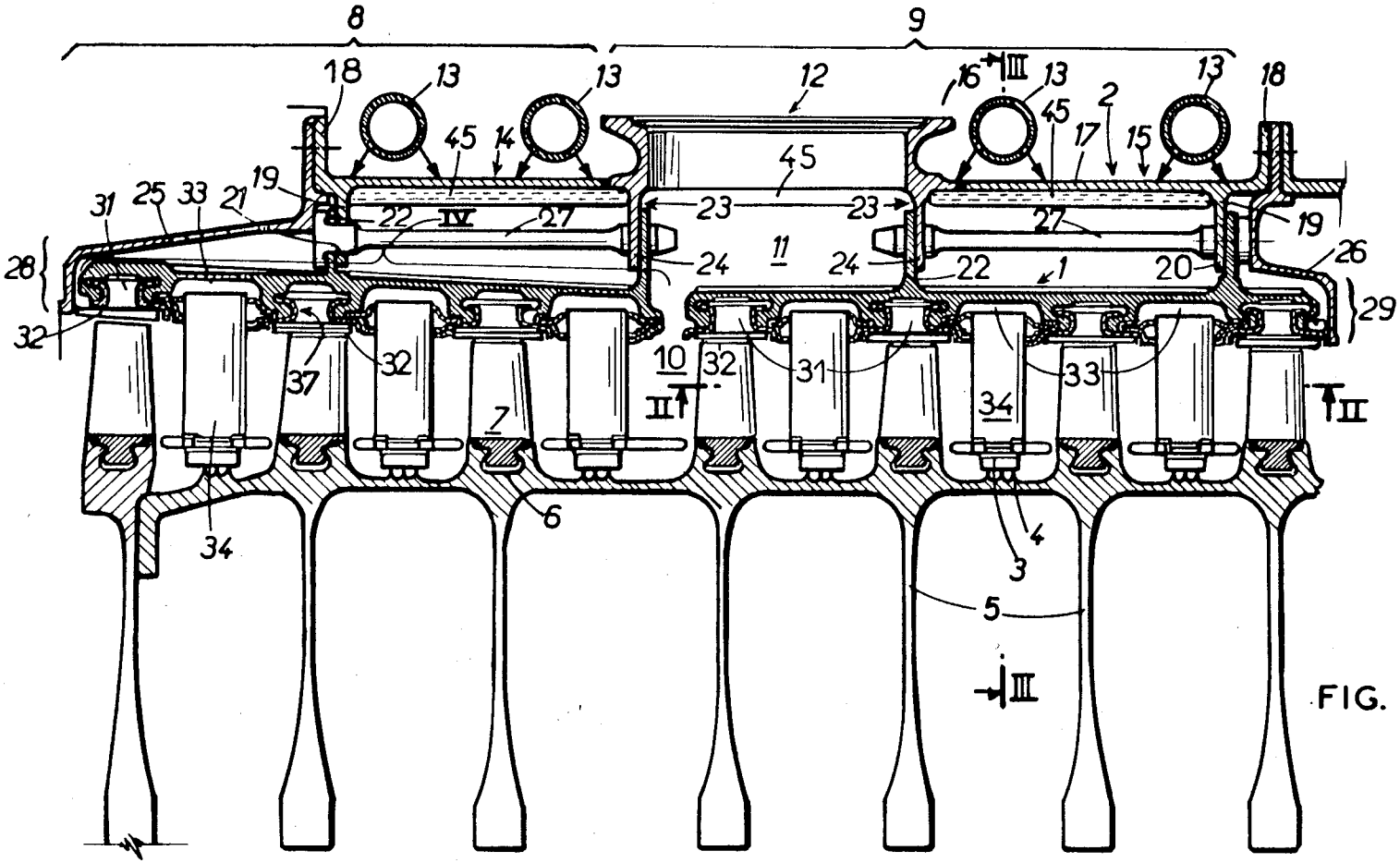
FIG. 1 shows a partial axial cross section of a compressor section according to the invention.

FIG. 1 shows an axial partial cross section of a compression section of an axial compressor, intended in particular for a turbojet engine. According to the example shown, the first three compression stages (to the left in FIG. 1) are located in an annular truncated channel, the widest part whereof receives the flow of air to be compressed. Successive compression stages are in a substantially cylindrical annular channel.

The housing of the compressor comprises two casings: an inner casing 1 and an outer casing 2. The inner casing, attached to the outer casing, carries the stator vanes 34 and friction bands 32 made of an abradable material, against which the ends of the blades of the rotor vanes rub.

The stator vanes carry at their free ends means to assure tightness with the rotor. These means conventionally consist of a friction band 3 against which bear sealing ribs 4 carried by the rotor casing between two rotor disks 5. The disks 5 of the rotor have in their rims a notch 6, in which the blades 7 of the rotor are retained.

The upstream section 8 of the compressor is separated from the downstream section 9 by a pickup zone 10 which is in communication with the space 11 formed between the inner and outer casing, and with the air intake 12 to supply the compressed air required for control of the temperature of the inner and outer casings, and for the cooling systems of the engine, such as the turbine. Ventilation galleries 13 (four in number in the example shown) are provided adjacent the sections of the outer casing 2, their function being to distribute ventilating air, by means of rows of orifices, along the surface of the casing 2.

Means for the control of the intake of air (not shown) by the galleries make it possible to control the temperature of the casing and, consequently, its dimensional variation. Clearances are thus maintained constant in spite of the different coefficients of thermal expansion of the rotor disks and the housing of the compressor on which the stator vanes are mounted.

The outer casing 2 consists of three cylindrical segments: an upstream segment 14 and a downstream segment 15, which are essentially symmetrical with respect to an intermediate segment 16.

The segments 14 and 15 consist of a cylindrical element 17 having at one end a radial external flange 18 and a radial internal flange 19. The radial internal flange 19 is notched at regular intervals to form mounting brackets 20 defining a mounting hole 21. These brackets serve to support the corresponding brackets 22 provided on the inner casing 1 as will hereinafter be explained in more detail.

The intermediate segment 16 has a cylindrical collar, the upstream and downstream edges of which are welded to the edges of the segments 14 and 15 for example by electron beam welding. Means are provided on the outside surface of the segment 16 to define air intake 12.

The intermediate segment 16 also contains adjacent each end a radial flange 23 directed inwardly and notched to form the brackets 24, each defining in their center a mounting hole. During the welding of the intermediate segment 16 to the upstream and downstream segments, the axes of the holes in brackets 20 and 24 are oriented parallel to the axis of the compressor.

The external flanges 18 serve to secure the sealing elements 25 and 26 to each end of the compressor section to assure tightness between the outer and inner casings, and to lock the fastening means 27, which may be pins or rods extending through brackets 20 and 24.

Figure 2:
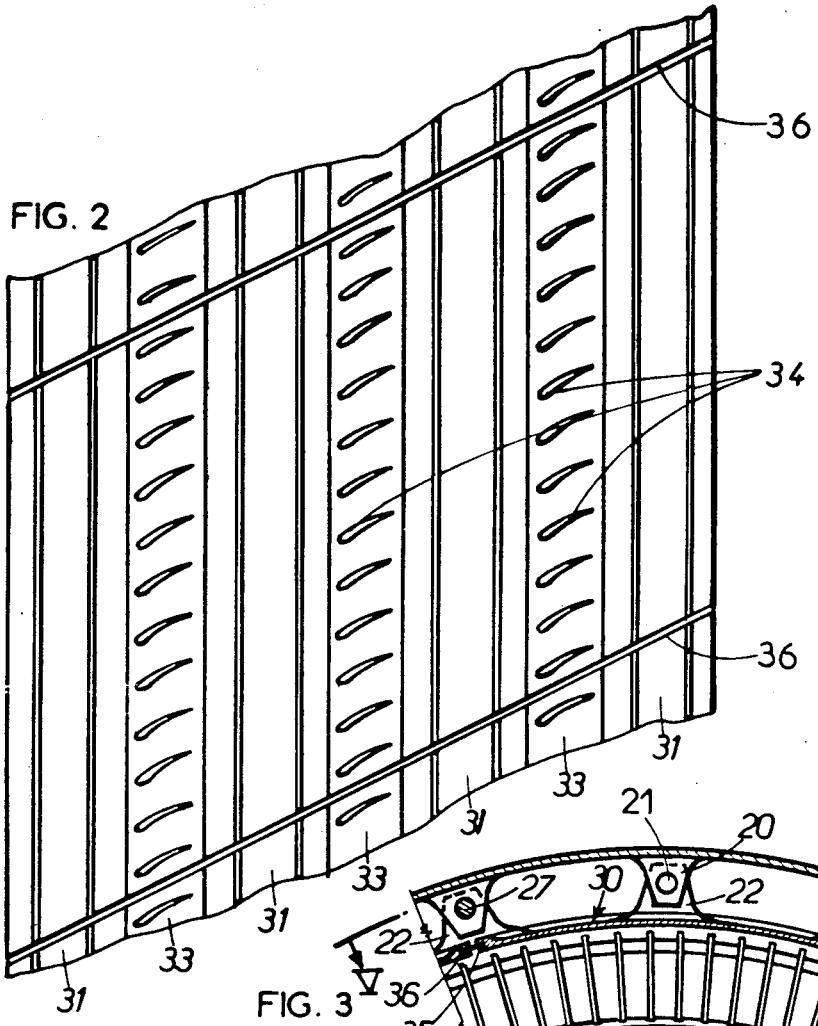
FIG. 2 is a partial view taken along section II—II in FIG. 1.
Figure 3:
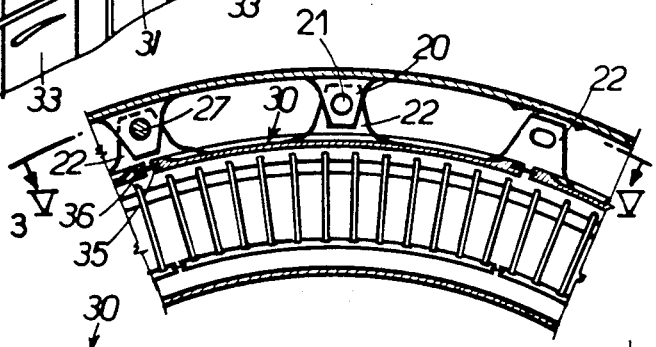
FIG. 3 is a partial view taken along radial section III—III in FIG. 1.
Figure 5:
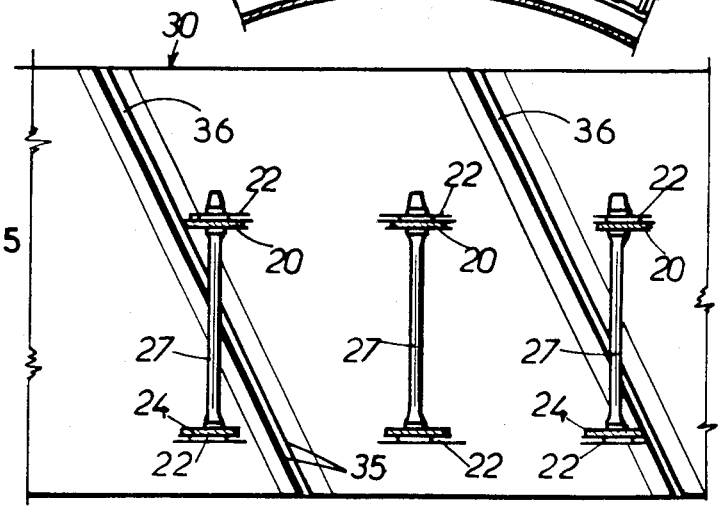
FIG. 5 is a partial view taken along section V—V in FIG. 3.

The inner casing 1 consists of two assemblies of arcuate segments, an upstream assembly 28 and a downstream assembly 29. FIGS. 3 and 5 show one of the arcuate segments 30, from which the inner casing 1 is formed. The projection of these segments 30 onto a horizontal plane (the plane of FIG. 2) is a parallelogram. The segments are placed so that their parallel sides are in radial planes while their lateral edges are disposed obliquely to the longitudinal axis 46 of the compressor.

The arcuate segments of the downstream assembly 29 have on their internal surface seven circumferential grooves as seen in FIG. 1. Four of the radial grooves 31 receive the friction bands 32 and three of the grooves 33 receive the stator blades 34, with the friction bands and the blades following each other alternatingly.

The segments also carry on their external surface, fastening brackets 22 which cooperate with the corresponding mounting brackets 20 and 24 provided inside the outer casing 2. The fastening of the brackets of the outer casing 2 to those of the inner casing 1 is effected by means of pins 27. Because the lateral edges of the segments 30 are not parallel to the axis of the compressor, alternate fastenings pins 27 are secured to two adjacent segments, as shown in FIG. 5.

The inner and outer lateral edges 35 (FIG. 3) of the segments 30 have a groove intended to receive a bar 36 to insure the radial tightness between two adjacent sectors.

The mounting holes 21 provided in the brackets 20 and 24 of the outer casing 2 are cylindrical, while the holes provided in the brackets 22 adjacent the edge of segments 30 are elongated as seen in FIG. 3. The other holes are cylindrical.

According to the invention circumferential grooves are provided in the internal surface of the segments 30. Shown in FIGS. 1 and 4, the grooves 31 which receive the friction bands, have a T-shaped configuration, with the base leg directed inwardly toward the axis of the compressor.

The grooves 33 receiving the stator vanes have a U-shaped cross section, with the sides of the grooves forming a recess. In order to maximally reduce the distance between the friction bands and the stator vanes, the recesses in the groove 33 are machined into the edges of the groove 31.

The friction bands 32 are fastened to supports 37, which consist of two U-shaped rings 38 brazed to both sides of a segment of cylindrical element 39. The friction bands, which are metallic or organic, are adhesively bonded or brazed to the internal surface of the segment 39.

Figure 4:
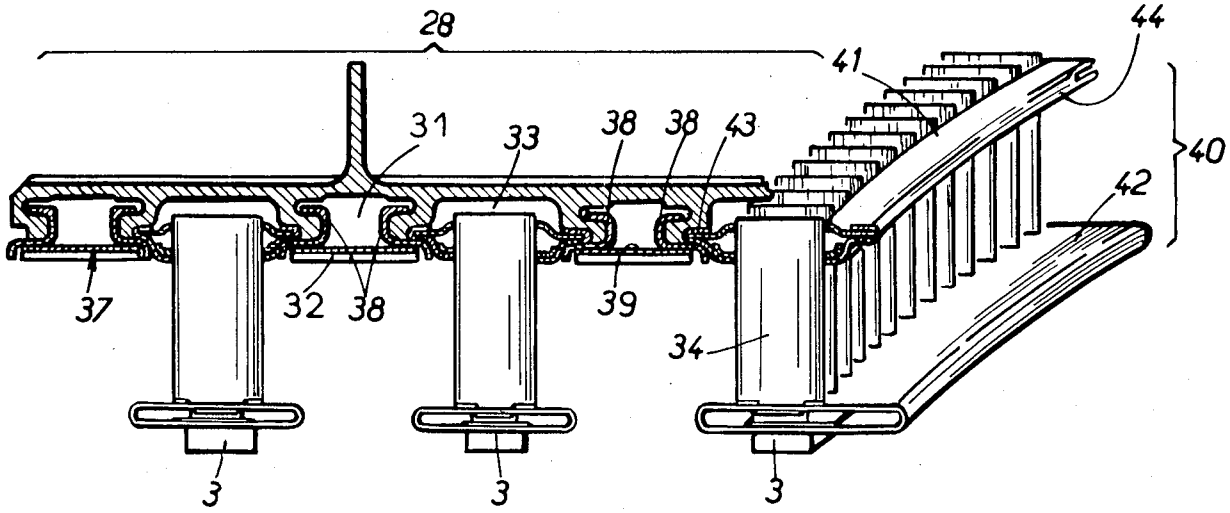
FIG. 4 is a partial view at an enlarged scale showing in perspective a sector of the stator vanes.

As best seen in FIG. 4, the stator vanes 34 are assembled in sectors 40 consisting of two segments of annular members 41,42, having recesses corresponding to the profile of the vanes and into which the vanes are brazed or adhesively bonded at their ends according to known techniques. The part of the segment of the member 42 directed toward the axis carries a friction band 3 which cooperates with the strips 4 on the rotor housing.

According to the embodiment shown in detail in FIG. 4, the segment of the member 41 is formed in the shape of a trough having on its peripheral edges two longitudinal tongues 43,44, shaped so that they fit into the recesses formed in the groove 33. The edges of the elements 39 forming the support of the friction bands 32, cover the recesses in the grooves 33, and hold the tongue 43,44 in the recesses.

The segment of the member 42, shown in perspective in FIG. 4, is wider than that of the member 44, in order to maintain the continuity of the annular channel, through which the compressed air flow, between the rotor blades.

In order to increase the thermal insulation of the outer casing 2, thermal insulation layer 45 is attached to its interior surface. This insulation assists in the reduction of heat transfer by radiation from the inner casing 1 to the outer casing 2.

The assembly of the compressor stator is effected as follows: the supports 37 of the friction bands 32 are slid into the grooves 31 of each arcuate segment 30, then, when all of the sectors of one assembly are equipped in this manner, the sectors 40 of the stator vanes are installed in similar fashion. The segments 30 are then preliminarily assembled around the rotor of the compressor and held in position by known means. The elements forming the outer casings 2 are then placed about the assembly such that their mounting brackets 20, 24 are aligned with the holes of the brackets 22 on the sections forming the inner casing 2. The pins 27 are inserted through the aligned holes and are secured in place by the fastening of the end sealing elements 25,26.

It is seen that the outer casing 2 is insulated by the thermal insulation 45 and ventilated by an air circulation in the space between the two casings. Its temperature, and thus its dimensional variation, may be controlled by the admission of more or less hot air via the galleries 13. The distance between the stator sectors and the outer casing may be controlled in this manner and, consequently, the clearance between the ends of the blades of the rotor and the friction bands 32 may be reduced to a minimum and maintaned nearly constant during transitory operations.

We claim:

1. A stator assembly for an axial compressor to control the relative thermal expansion between the stator assembly and a rotor having a plurality of rotor blades thereon, wherein the stator assembly is disposed about the rotor assembly and comprises:

(a) an annular inner casing having an interior surface and an exterior surface, the interior surface defining a plurality of circumferential grooves, the inner casing comprising a plurality of arcuate segments, each segment having parallel lateral edges disposed obliquely to a longitudinal axis of the compressor;

(b) means to attach a plurality of stator vanes to alternate ones of the circumferential grooves in the inner casing;

(c) a plurality of first friction bands;

(d) means to attach the first friction bands in the circumferential grooves between the stator vanes;

(e) an outer casing disposed about the inner casing so as to define an annular space therebetween;

(f) means to direct a portion of the air passing through the compressor into the annular space between the inner and outer casings;

(g) a plurality of first brackets attached to the exterior surface of each arcuate segment of the inner casing, each of the first brackets defining an opening therethrough with its axis extending generally parallel to the longitudinal axis of the compressor, at least one bracket on each arcuate segment being longitudinally aligned with a bracket on an adjacent arcuate segment;

(h) a plurality of second brackets distributed about an interior surface of the outer casing, each of the second brackets defining an opening therethrough, the openings defined by the second brackets being adjacent and aligned with corresponding openings defined by the first brackets; and, (i) pin means inserted through the aligned openings of the first and second brackets to retain the inner and outer casings in assembled relationship and to attach adjacent arcuate segments together.

2. The stator assembly of claim 1 wherein alternate ones of the circumferential grooves in the interior surface of the inner casing having a generally "U" shaped cross-section, each of the sides of the "U" further defining a recess and wherein the means to attach the plurality of stator vanes comprises: a plurality of segments forming an annular member, the segments being attached to a first end of each of the stator vanes; longitudinal tongues extending from either side of the segments, the tongue shaped so as to be received in the recesses of the circumferential grooves; and, a plurality of "U" shaped rings engaging the sides of alternate ones of the circumferential grooves and extending in a longitudinal direction so as to retain the longitudinal tongues in their respective recesses.

3. The stator assembly of claim 2 further comprising a second plurality of segments attached to a second end of the stator blades, and a second friction band attached to the second segments.

4. The stator assembly of claim 2 wherein the means to attach the first friction bands to the circumferential grooves in the inner casing comprises: a cylindrical element attached to the first friction bands and to a pair of the "U" shaped rings attached to the cylindrical element.

5. The stator assembly of claim 1 further comprising means to lock the pins in their inserted position.

6. The stator assembly of claim 5 wherein the means to lock the pins in their inserted position comprises sealing elements attached between the inner and outer casings to render the annular space between them air tight.

7. The stator assembly of claim 1 further comprising a layer of thermal insulation attached to the interior surface of the outer casing.

8. The stator assembly of claim 1 wherein the outer casing comprises: (a) an upstream section; (b) an intermediate section defining an air intake; and (c) a downstream section.

9. The stator assembly of claim 8 wherein the inner casing comprises an upstream section and a downstream section, the sections being longitudinally spaced from each other to define an air pickup zone to allow a portion of the air passing through the compressor to flow into the annular space between the inner and outer casings.

* * * * *

UNITED STATES PATENT AND TRADEMARK OFFICE

CERTIFICATE OF CORRECTION

PATENT NO. : 4,543,039

DATED : September 24, 1985

INVENTOR(S) : RUIS et al

It is certified that error appears in the above-identified patent and that said Letters Patent is hereby corrected as shown below:

Col. 5, line 43: "having" should read -- have --.

Signed and Sealed this

*Third* Day of *June 1986*

[SEAL]

*Attest:*

DONALD J. QUIGG

*Attesting Officer*

*Commissioner of Patents and Trademarks*